United States Patent [19]

Pavie

[11] Patent Number: 4,601,396

[45] Date of Patent: Jul. 22, 1986

[54] METHOD AND DEVICE FOR SORTING FLAT AND INDEXED ARTICLES

[75] Inventor: Claude Pavie, Houilles, France

[73] Assignee: HBS, France

[21] Appl. No.: 674,792

[22] Filed: Nov. 26, 1984

[30] Foreign Application Priority Data

Nov. 25, 1983 [FR] France ..... 83 18851

[51] Int. Cl.[4] ..... B07C 3/10; G06F 15/20

[52] U.S. Cl. ..... 209/569; 209/584; 209/900; 270/58; 270/95; 271/3.1; 271/289; 271/290; 364/478

[58] Field of Search ..... 209/563–566, 209/569, 583, 584, 900; 235/475–477; 270/58, 95; 271/3.1, 289, 290; 364/464, 478

[56] References Cited

U.S. PATENT DOCUMENTS

| | | | |
|---|---|---|---|
| 3,452,509 | 7/1969 | Hauer | 209/900 X |
| 4,247,008 | 1/1981 | Dobbs | 209/900 X |
| 4,277,057 | 7/1981 | Jaedicke | 270/58 |
| 4,347,936 | 9/1982 | Fasig | 209/900 X |
| 4,388,994 | 6/1983 | Suda et al. | 209/900 X |

FOREIGN PATENT DOCUMENTS

| | | | |
|---|---|---|---|
| 0092460 | 10/1983 | European Pat. Off. | 209/900 |
| 55-123842 | 9/1980 | Japan | 271/289 |

OTHER PUBLICATIONS

IBM Technical Disclosure Bulletin No. 13, No. 5, Oct. 1970, R. H. Hillsley et al., "Recycling Document Sorting and Sort Algorithm", pp. 1345–1348.

IBM Technical Disclosure Bulletin, vol. 20, No. 1, Jun. 1977, C. A. Beehler et al., "Job Separators" pp. 23–24.

*Primary Examiner*—Robert B. Reeves
*Assistant Examiner*—Edward M. Wacyra
*Attorney, Agent, or Firm*—Sughrue, Mion, Zinn, Macpeak, and Seas

[57] ABSTRACT

A method and device for sorting flat and indexed articles are disclosed, the method involving two passes. In the first pass, articles having a destination common to a very large member of articles are sorted and distributed to N/2 receptacles (10), the receptacles being fewer in number than the total number (N) of possible destinations for the articles, while the other articles are put aside in a buffer receptacle (12). In the second pass, a control circuit (7) assigns new destinations to the sorting receptacles, placing a marker (16) after each pack of articles contained in the receptacles, and the articles initially set aside (21) are resorted to the new destinations. The invention is particularly applicable to mail sorting.

10 Claims, 2 Drawing Figures

METHOD AND DEVICE FOR SORTING FLAT AND INDEXED ARTICLES

Figure 2:
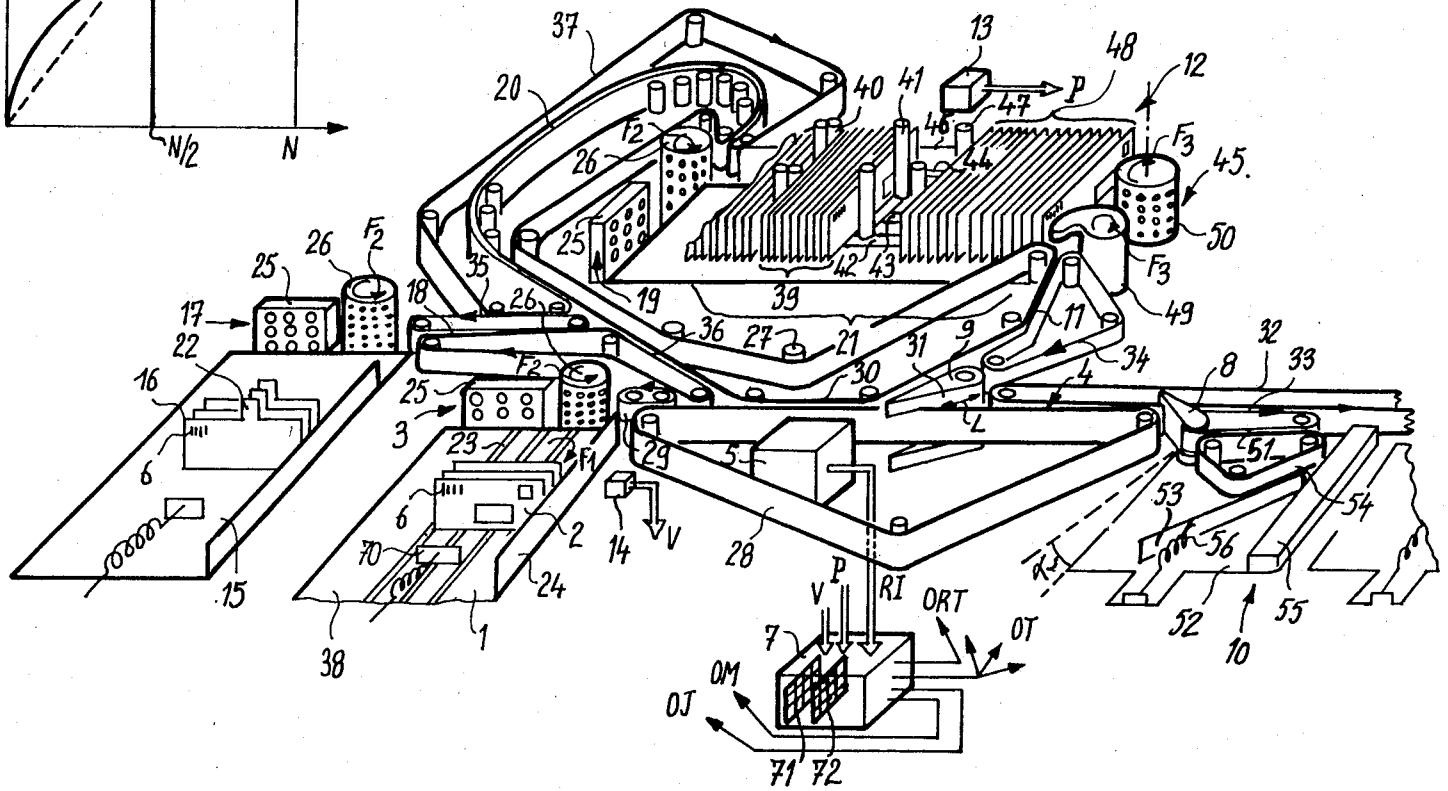

This invention concerns a method for sorting flat and indexed articles as well as a device for carrying out said method, both of which are particularly applicable to the sorting of mail.

In the broadest sense, mail sorters comprise a magazine designed to store flat articles to be sorted, on edge, and an extracting mechansim or unpiler operable to draw them out of the magazine one by one. Said extractor directs each extracted article past a read head, which recognizes the indexes or sort codes placed on each article. The read head conveys the index information to a control circuit which transforms the information into sort commands and transmits these commands to the actual sorter. The sorter comprises a plurality of receptacles arranged parallel to one another along a conveyor which connects them to the read head. Each receptacle contains diverting means operable to intercept the articles as they move along the conveyor and to direct them to itself in accordance with the sort commands. Each receptacle thus collects all the articles to be sorted which must be sent to a given destination. Arraying means are provided for each receptacle to arrange the articles fed thereto in the correct order. For various reasons, such as for the purpose of having a finely discriminated sort and a large sorting capacity, a considerable number of receptacles are required, most applications requiring about 100 receptacles.

However, not only is it costly to multiply the receptacles, but the articles' distribution by destination is far from constant. A great number of articles tend to be assigned to only a few destinations, while other destinations are seldom used.

In practice, the assignee has noted that in most mail sorting applications, 90% of the articles sorted are assigned to only 50% of all possible destinations and the remaining 10% are distributed over the other 50% of the possible destinations. This results in an under-utilization of the latter 50% tending to make them an unprofitable investment.

It is therefore an object of the present invention to provide an improved method and/or device eliminating the above-mentioned drawbacks through a considerable reduction of the number of sorting receptacles required.

The invention provides a method for sorting flat and indexed articles, of the type where flat articles stored in a magazine are extracted or unpiled therefrom one by one, each article is directed past a read head recognizing the index and instructions are transmitted to a sorting device to receive and dispatch the articles to the appropriate receptacle according to recognized destination indexes, whereby, the number of sort receptacles being less than the total number of possible destinations, the following cycle of operations is repeatedly carried out:

- articles having a destination for which no sorting receptacle is provided are put aside or bypassed to a buffer receptacle, while the remaining articles are sent to their respective receptacles;
- a marker is placed at the top of each pile of articles in the assigned storage receptacles;
- new destinations are assigned to all the existing sorting receptacles;
- and all the buffered articles are then resorted and sent to the new destinations.

The invention also provides a device for sorting flat and indexed articles, consisting of a magazine containing the flat articles to be sorted, an unpiler or extractor to extract the articles therefrom one by one and direct them past a read head which recognizes the indexes and a control circuit to receive from the read head the index information and generate the sort instructions to be carried out by a sorter, wherein said sorter has a number of sorting receptacles which is less than the total amount of possible article destinations, to receive that part of the articles having destinations matching said receptacles, and a buffer receptacle to hold the articles having no matching receptacle for their destinations, and wherein the sorting device comprises means to interrupt sorting, place a marker at the top of the pile of articles in existing receptacles, assign a new destination to each receptacle and execute the resorting of the articles initially routed to the buffer receptacle.

Figure 1:
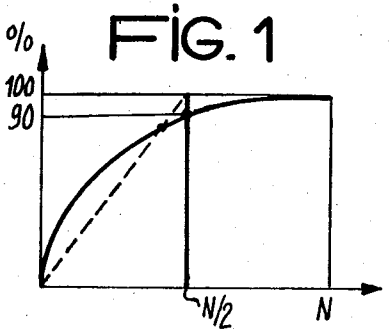

The present invention will be more readily understood in reading the following description, taken in conjunction with the accompanying drawings, in which:

FIG. 1 is the cumulative distribution curve of the articles by destination, and FIG. 2 shows a sorting device according to the invention.

In FIG. 1, the percentage of articles to be sorted is plotted on the Y-axis and the total number (N) of destinations where the articles are to be sent are plotted on the X-axis. This curve illustrates the fact already mentioned that about 90% of the articles are distributed among N/2 directions, where N directions are the destinations of all articles. Consequently, the first half of the sort receptacles receive almost the whole amount of articles to be sorted, whereas a minor proportion thereof, or about 10%, goes to the other half of the receptacles. The broken line curve indicates an embodiment of the invention which sorts all the articles or 100% in N/2 receptacles, whereby the above-indicated saving is achieved.

The sorting device illustrated in FIG. 2 comprises a magazine 1 containing the flat articles 2 to be sorted on edge. Each article 2 is individually seized by an unpiler 3 which enters it into a conveyor 4. The conveyor 4 directs the articles 2 past a read head 5. The read head 5 recognizes the indexes 6 carried by each article and transmits the index identification information RI to a control circuit 7. The indexes 6 may be markings such as bar codes. The circuit 7 then generates the sort commands, OT, and transmits these to the diverting means 8 of each sorting receptacle or to the diverting means 9 of the buffer receptacle. During the first pass, this buffer diverting or routing means 9 allows any article whose index 6 corresponds to a destination, which destination is statistically otherwise known to be common to many articles, to pass into conveyor 4 en route to a receptacle 10 corresponding to said destination. Said article is stacked on edge in the receptacle by the effect of the receptacle's diverting means 8. The receptacles such as 10 are sorting receptacles and in one embodiment there are as many of them as half the total number of possible article destinations. If however an article's destination does not correspond to any of the assigned destinations of the sorting receptacles, the sort command, OT, is sent to the buffer routing diverting means 9 so that this article will be routed by a conveyor 11 to buffer receptacle 12. When the buffer receptacle 12 is full or no article presence is any longer detected in magazine 1, sorting is interrupted by a magazine command, OM, from circuit 7 to the magazine 1. It can be known when the buffer receptacle 12 is full by means of a detector 13 designed to send a "full" detection signal P to circuit 7. It can be known when magazine 1 is empty by means of a detector 14 designed to send an "empty" detection signal V to same said circuit 7.

On receiving such signals, control circuit 7 sends a marker command, OJ, to a marker 16 magazine 15. Magazine 15 is in relation with an unpiler 17 exactly like unpiler 3. In response to command OJ, unpiler 17 sends via a conveyor 18 and via part of conveyor 4 as many markers 16 as there are receptacles 10. These markers are counted in passing before read head 5 so that the sort orders OT generated by control circuit 7 will cause one marker to top each pile of articles stacked in each of the receptacles 10. For purposes of rationalizing the operation of the read head 5, each marker can carry an index 6 such that it will be sorted into the receptacles 10 just as the articles were sorted.

Once all the markers are in place—an event which may be known by any number of means and in particular by counting the markers or by reading the index on a given one of them—a new destination is assigned to each sorting receptacle. In other words, each of the sorting receptacles will now be the receiver for articles whose destination had not, in the first pass, been associated with any destination common to a large number of articles. To summarize, the same receptacles 10 are now given destination assignments corresponding to the indexed destinations for the articles stored in the buffer receptacle 12.

Once this switching of destinations has been effected, a second sorting pass is carried out to sort the articles in the buffer. The resort order, ORT, is generated by the same control circuit 7. To carry out the new sort, receptacle 12 forms a magazine connected with an extractor or unpiler 19 of the same type as unpilers 3 and 17, which seizes the previously bypassed articles one at a time and routes them back, via a conveyor 20 and part of conveyors 18 and 4, in front of read head 5 for their final sorting.

Keeping the same basic form, the invention can be put into practice in several different ways. Firstly, the markers 16 can be disposed at the end of the stack of articles 2 contained in magazine 1. Secondly, the same markers can be disposed at the top or front of the series of articles 21 contained in the buffer receptacle 12. In the latter case, and assuming that receptacle 12 is of the first-in-first-out type (FIFO), these markers would be fed to the top of the stacks in the receptacles 10 prior to starting the sorting operation on the bypassed or buffered articles. In both cases, detectors 14 or 13 will tell circuit 7 when it is time to assign a new destination to each receptacle 10; in the first case the markers 16 will be coded or given indexes 6 corresponding to the initial destinations and in the second case they will be indexed to the new destinations.

Alternatively, it is also possible to reverse the order of the main sorting passes to first distribute the articles going to uncommon destinations and next distribute the larger quantity of articles going to the more common destinations. This procedure is less worthwhile than the one previously described because it requires putting the bulk (90%) of the articles in the buffer receptacle 12, instead of the smaller number stored there in the preferred embodiment.

Yet another alternative is obviously to manually insert the markers 16 between the two passes and/or to manually gather the stack 21 of articles initially loaded into the buffer receptacle 12 to place it in the magazine 1 for further sorting.

To continue with the description of the sorting operation, at the end of a sort operation, each receptacle contains a row of articles corresponding to two different destinations, with a marker in between to segregate them. To make the difference more obvious the markers 16 are provided with salient features 22 such as a physical projection as shown in the drawing, or any other suitable magnetic, color or shape feature or different indexing. In the case described in the foregoing, the number of receptacles 10 is greater than or equal to half N/2 the total number of article destinations. If equal, then each receptacle contains at least one marker and articles for two destinations. If greater, then some of the receptacles contain only articles for a single destination. For more limited applications, the marker placing step can be repeated such that each stack of articles will contain articles for as many as three or more destinations at the end of the sorting operation. There will always be one less marker than the number of destinations in each receptacle.

A further feature of the method according to the invention is that there are several ways of correlating together the destinations of the articles contained in any given receptacle. They can be correlated according to geographical criteria (destinations corresponding to neighboring geographical locations), to index coding criteria or, preferably, to yield receptacle stacks having as nearly as possible the same number of articles. The latter can be done by associating with the receptacle receiving the articles whose destination is common, statistically, to the greatest number of articles, the articles whose destination is statistically common to the least number of articles. For example, a first receptacle would contain the articles for destination No. 1 and destination No. N; a second receptacle would contain the articles for destination No. 2 and destination No. N-1, and so on. In this case the cumulative curve or broken-line curve of FIG. 1 would be a substantially straight line.

The device which will now be described is a preferred embodiment of the device implementing the method of the invention.

The magazine 1, is of the type described in assignee's U.S. Pat. No. 4,167,227, particularly comprising, on its base plate 38 a set of rolls 23 rotating about their axes in the direction of arrow F1 such as to suitably drive each of the flat articles contained in said magazine against a jogging plate 24. This smoothes the extraction of the articles. Thrusting means 70 ensure suitable application of said articles 2 against the unpiler or extractor 3, which unpiler is of the type described in assignee's U.S. patent application, Ser. No. 466,672. Specifically, it comprises a "wind box" 25 attracting to itself a first article to be extracted and a hollow drum unpiler 26 rotating in the direction of arrow F2. Drum 26 rotates continuously. Its wall is provided with a plurality of holes arranged on the generatrix of the drum to interface with the articles to be extracted. The holes are controlably connected to a vacuum source such that, whilst rotating, the drum sucks towards itself the first article applied there against and urges it into the conveyor 4. This vacuum source, connected to the wind box 25 and the drum 26, and the drum suction controlling means themselves are not included in the drawing.

Conveyors 4, 11, 18 and 20 are belt-type conveyors enabling flat objects to be conveyed on edge by a squeezing action between two belts pressed against one another. Each of said conveyors is thus determined by two belts over its entire length. The running direction of each belt is indicated with arrows in the drawing to show their direction of movement around sheaves such as sheave 27 which serve to define their path and drive them. A first part of conveyor 4 is determined by a belt 28, termed the read belt, going past read head 5 and by another, magazine 1 extraction belt 29. A second part of conveyor 4 is determined by the same belt 28 and by a buffer routing belt 30. A third part of conveyor 4 is determined by said belt 28 and by the sorting surface 31 of a diverting vane 9. To ensure correct working of this part of conveyor 4, the length L of this surface 31 is made less than the length of the articles to be sorted. The last part of conveyor 4 is more conventionally determined by a sorting belt 32 to one side and by a section of belt 28 and by receptacles 10 routing belts 33, in that order, to the other side.

Conveyor 11 is formed by buffer routing belt 30 and a belt 34. Conveyor 18 is formed by marker magazine 16 extraction belt 35 and a belt 36. Belt 36 cooperates with belt 30 to merge conveyor 18 with conveyor 4 upstream from the sorting read head 5. Finally, conveyor 20 is determined by buffer receptacle extraction belt 30 and a belt 37 which faces belt 30 along the entire length of conveyor 20. Belt 37 cooperates with belt 30 to merge conveyors 20 and 18 upstream from the latter's merging with conveyor 4. The layout or configuration of conveyors illustrated in FIG. 2 is obviously given merely by way of example, other configurations being possible within the scope of the invention. It nevertheless deserves to be noted that conveyor 11 in this example introduces articles being bypass routed to buffer receptacle 12 on the side opposite the one from which they are extracted by conveyor 20. The reason for this is that the indexes 6 appearing on only one side of the articles to be sorted must be able to be read by head 5 during the second sorting pass.

Buffer receptacle 12 is preferably a dynamic or "flow-type" storage device like the one described in assignee's U.S. patent application, Ser. No. 556,868. One of the features of this device is that the articles stored therein are gathered into packs such as pack 39. The articles are maintained on edge by fingers 40 on a front carriage and fingers 41 on a back carriage, supporting each side of the pack. The front and back carriages can move independently of one another. They are driven by a set of five chains like chains 42, 43 and 44, said carriages cooperating with said chains by means of retractable locking devices. The thicknesses of packs 39 can be varied and differentiated at will. This flow storage device is interposed between a piler 45 and the unpiler 19. Due to the presence of the five chains, stacking or piling and unpiling are independently operable. Each can be operated on the basis of an individualized sequence. In order to smooth the extraction operations by unpiler 19 in removing articles from said flow storage 12 (buffer receptacle) the latter can be provided with rolls for jogging the articles against a jogging plate 46 just like the rolls 23 of magazine 1. The uncoupling of the travel motions of the front carriages and back carriages by the action of the five chains makes it possible, in the course of the transfer from piler 45 to unpiler 19, to bulge or "unream" the packs 39 in view of improving the rolls' jogging action. Said rolls are not shown in the drawing.

Assuming that the position of the front or back carriages is known by the control circuit 7 also controlling said flow storage device 12, it is possible to replace detector 13 by a computation algorithm measuring the space between the last back carriage 41 of the stack of articles awaiting unpiling by item 19 and the last front carriage 47 closing the pack 48 in the course of stacking by piler 45. When this space shrinks beyond a predetermined threshold, this can stand for a buffer 12 "receptacle full" indication equivalent to a "full" detection signal P. Fingers 40 and 41 retract when they approach unpiler 19 and extend when in front of piler 45.

Piler 45 is of the same type as that described in assignee's U.S. patent application, Ser. No. 565,816. Its most notable features include a comma-shaped escapement 49 rotating one turn in the direction of arrow F3 upon the arrival of a bypassed article, a rotating drum 50 sequentially connected to a vacuum source to ensure correct jogging of bypassed articles against jogging plate 46, and a skewed feed in relation to the direction of motion of the articles in buffer receptacle 12. This skewing results from the orientation of conveyor 11. Rotating drum 45 is constructed like rotating drum 26 of unpilers 3, 17 and 19, but operates in the opposite direction.

The sorting receptacles 10 are like those described in assignee's U.S. patent application, Ser. No. 428,333. They feature an edge-stacking device comprising two belts, these being the passing belt 33 and a piling belt 51, friction-driven by belt 33. The base plate 52 of receptacles 10 is inclined at an angle $\alpha$ from horizontal, said angle, in one example, being 23°. When stacked, the flat articles are held up, at the end opposite the piling area, by a holding blade 53. This blade runs parallel to piling face 54 of belt 51. Face 54 and blade 53 are slightly inclined relative to a jogging plate 55 of receptacle 10 against which the articles to be stacked are aligned. The blade 53 is thrust towards the stacking or piling belt 51 by a spring 56 pushing against the receptacle 10.

The control circuit 7 is a logic circuit. According to a preferred embodiment, it comprises a microprocessor enabling all the previously described functions to be performed. There are no special problems associated with programming this microprocessor. Its only noteworthy feature is that it comprises memory tables matching up each receptacle with a destination. In the embodiment described hereinbefore involving a two-pass sorting procedure, the microprocessor thus has two memory tables, 71 and 72, enabling it to switch the destinations after the first pass. Accordingly, two articles with different destinations can, from one pass to the next, be stacked in a same receptacle 10 after placement of a marker 16.

This invention provides a solution to another problem—namely the problem of space associated with the number of receptacles. Since there are fewer of the latter, the overall bulk of the sorting device according to the invention is also reduced.

I claim:

1. Method for sorting flat, indexed articles, where said articles are stored in a magazine, extracted or unpiled therefrom one by one, each article being directed past a read head recognizing its indexing, sort commands are sent to a sorting device to receive and distribute each article to a sorting receptacle corresponding to its destination according to recognized destination indexes, whereby, the number of sorting receptacles being less than the total number of possible destinations, the following steps are cyclically performed:

articles having a destination for which no sorting receptacle is provided are put aside or bypassed to a buffer receptacle, while the remaining articles are sent to their respective sorting receptacles;

a marker is placed at the top of each pile of articles in the assigned sorting receptacles;

new destinations are then assigned to all the existing sorting receptacles;

and all the buffered articles are then redirected past the read head and sent to the sorting receptacles having the new destinations.

2. Method as in claim 1, whereby sorting is carried out in two passes, the number (N/2) of sorting receptacles being greater than or equal to half of the number (N) of possible destinations.

3. Method as in claim 2, whereby the second pass is carried out when the buffer receptacle has been filled up, temporarily interrupting the unpiling of articles from said magazine.

4. Method as in claim 2, whereby said new destinations are correlated with the first destination assignments of said sorting receptacles.

5. Device for sorting flat, indexed articles, consisting of a magazine containing the flat articles to be sorted, an unpiler or extractor to extract the articles therefrom one by one and direct them past a read head which recognizes the indexes, and a control circuit to receive from the read head the index information and generate sort instructions to be carried out by a sorter, wherein said sorter has a number of sorting receptacles which is less than the total amount of possible article destinations, to receive that part of the articles having destinations matching said receptacles, and a buffer receptacle to hold the articles having no matching receptacle for their destination indexes, and wherein the sorting device comprises means to interrupt said sorter, means to place a marker at the top of the pile of articles in existing-destination sorting receptacles, means to assign a new destination to each sorting receptacle and means to restart said sorter to execute the resorting of the articles initially routed to the buffer receptacle.

6. Device as in claim 5, wherein said marker placing means include an unpiler from a marker magazine, connected in parallel with said article magazine unpiler.

7. Device as in claim 5 or 6 wherein said means to execute the resorting of the articles initially routed to the buffer receptacle includes a buffer receptacle unpiler operable to seize the articles contained in said buffer receptacle and is connected to said sorter in parallel with said article magazine unpiler.

8. Device as in claim 5, wherein said buffer receptacle is a flow storage device for flat articles.

9. Device as in claim 5, wherein said buffer receptacle comprises means for detecting when it is full.

10. Device as in claim 5, wherein said markers feature suitable physical, magnetic, color or other coding means to make their presence obvious in a pile of articles stacked in a sorting receptacle.

* * * * *